US006302216B1

(12) United States Patent
Patel

(10) Patent No.: US 6,302,216 B1
(45) Date of Patent: Oct. 16, 2001

(54) FLOW CONTROL AND ISOLATION IN A WELLBORE

(75) Inventor: Dinesh R. Patel, Sugar Land, TX (US)

(73) Assignee: Schlumberger Technology Corp., SugarLand, TX (US)

( * ) Notice: Subject to any disclaimer, the term of this patent is extended or adjusted under 35 U.S.C. 154(b) by 0 days.

(21) Appl. No.: 09/441,817

(22) Filed: Nov. 17, 1999

Related U.S. Application Data

(60) Provisional application No. 60/108,953, filed on Nov. 18, 1998, and provisional application No. 60/108,910, filed on Nov. 18, 1998.

(51) Int. Cl.[7] ..... E21B 34/10

(52) U.S. Cl. ..... 166/375; 166/321; 166/332.4; 166/334.2; 166/386

(58) Field of Search ..... 166/374, 375, 166/386, 321, 324, 332.3, 332.4, 332.7, 334.2

(56) References Cited

U.S. PATENT DOCUMENTS

| | | | | |
|---|---|---|---|---|
| 3,860,066 | * | 1/1975 | Pearce et al. | 116/72 |
| 3,882,935 | * | 5/1975 | Calhoun | 166/224 |
| 4,942,926 | | 7/1990 | Lessi . | |
| 5,547,029 | * | 8/1996 | Rubbo et al. | 166/375 |
| 5,704,426 | | 1/1998 | Rytlewski et al. . | |
| 6,085,845 | * | 7/2000 | Patel et al. | 166/373 |
| 6,227,298 | * | 5/2001 | Patel | 166/321 |

FOREIGN PATENT DOCUMENTS

| | | |
|---|---|---|
| 2 320 269 A | 6/1998 | (GB) . |
| WO 98/09055 | 3/1998 | (WO) . |
| WO 00/29715 | 5/2000 | (WO) . |

* cited by examiner

*Primary Examiner*—William Neuder
*Assistant Examiner*—Zakiya Walker
(74) *Attorney, Agent, or Firm*—Trop, Pruner & Hu PC

(57) ABSTRACT

A method and apparatus of performing fluid loss, well isolation control, and flow control in a well having multiple zones. A multi-valve system having a plurality of valve assemblies is installed into the well. The multi-valve system provides fluid loss and well isolation control during running of the upper completion and provides flow control during production or other operation of the well. A control line carrying fluid pressure is run from the surface to the plurality of valve assemblies, with the control line capable of selectively actuating more than one valve assembly. In one example arrangement, the control line carries nitrogen gas to the multi-valve system. A fast bleed and slow bleed device at the well surface is connected to the control line. One of the fast bleed and slow bleed devices may be employed to open or close a selected one of the valve assemblies. In another arrangement, the control line and activating mechanism may be used for other types of pressure-actuated devices.

41 Claims, 9 Drawing Sheets

FLOW CONTROL AND ISOLATION IN A WELLBORE

This application claims the benefit under 35 U.S.C. §119(e) of U.S. Provisional Application Ser. No. 60/108,910, entitled "Well Completion System for Isolation and Flow Control," filed Nov. 18, 1998; and U.S. Provisional Application Ser. No. 60/108,953, entitled "Multiple Valve System for Flow Control," filed Nov. 18, 1998.

BACKGROUND

The invention relates to flow control and isolation in a wellbore.

One of the operations performed in completing a wellbore is perforating one or more formation zones to allow hydrocarbons to flow into the wellbore. Typically, a gun string is lowered to the desired well interval and fired to create openings in the surrounding casing or liner and to extend perforations into the surrounding formation. Another operation that may be performed includes sand control in zones that may produce sand or other contaminants. One technique for performing sand control includes gravel packing.

To avoid having to use kill fluids after a formation has been perforated or gravel packed, formation isolation valves (FIVs) or other types of isolation devices may be used. An FIV may include a ball valve, a sleeve valve, a flapper valve, or some other valve. In one application, an FIV may be closed to allow a gun string or gravel pack service tool to be pulled out after perforation or gravel packing has been performed. Closing of the FIV also allows the upper part of a wellbore to be further completed. FIVs may be operated with a number of different mechanisms, including a shifting tool, a tubing pressure-activated mechanism, or a control line pressure-activated system.

To provide fluid loss and well isolation control in a well with multiple zones while an upper part of the well is being completed, multiple isolation devices may be used for each respective zone. Examples of completion operations in the upper part of the well include installing the following components: setting a production packer, installing downhole monitoring and control modules (such as those associated with an intelligent completion system), installing a subsurface safety valve (SSV), inserting a production tubing, and installing other components.

However, adequate well isolation control may not be provided with use of individual isolation devices, particularly if the upper completion string includes components run outside the production tubing, such as cables, control lines, and so forth. As soon as the upper isolation device is opened, the upper zone is unprotected and the well may start taking fluid. The time to complete installation of the completion string to the depth of the lower zone, especially with intelligent completion equipment, may be relatively long. If well isolation control is required, a blow-out preventer (BOP) at or near the surface may be closed. Typically, the BOP seals on the outer diameter of a production tubing. However, if cables or other components are attached to the outside of the tubing, the BOP may not seal properly. In addition, closing the BOP may damage such components attached to the outside of the production tubing.

To better provide fluid loss and well isolation control, a formation isolation dual valve (FIDV) may be used. In one example FIDV, a ball valve is used to isolate one zone and a sleeve valve is used to isolate another zone. In conjunction with an isolation packer, the FIDV provides protection for multiple zones while the upper portion of the completion string is being installed.

In a multi-zone wellbore, once an FIDV and associated components are installed, a flow control device may be run into the wellbore and installed above the FIDV to perform flow control of the two or more zones during production. However, installing a separate isolation device (e.g., FIDV) for fluid loss control and flow control device adds to the complexity of completion operations. Effectively, two sets of valves are used for each zone, one for isolation and the other for flow control. Installing the extra components adds to the time and costs of completing a well. In addition, the presence of extra components increases the likelihood that failure of some downhole component would occur, which would then require a work-over operation that typically includes pulling out the completion string, replacing the failed component, and re-installing the completion string. Such work-over operations are extremely expensive and time-consuming.

A need thus exists for an improved method and apparatus for performing flow control and isolation of a wellbore having a plurality of zones.

Various mechanisms may be used to control activation of downhole valves. Such mechanisms may be electrically-activated, pressure-activated, or mechanically-activated. Pressure activation may be accomplished by communicating pressure through a production tubing or through one or more control lines running along side the tubing. However, once production of fluids starts, communication of a desired pressure through the tubing may not be possible. Control lines may be used instead. Conventionally, separate hydraulic control lines have been used for different flow control devices. The existence of multiple control lines downhole may make installation of a completion string more difficult, which increases the costs associated with the operation of a well.

A need thus exists for a method and apparatus to reduce the number of control lines that need to be run downhole for controlling activation of downhole components, such as valves, from the well surface.

SUMMARY

In general, according to one embodiment, a multi-valve assembly for use in a well having a plurality of zones includes a first valve in communication with a first zone and a second valve in communication with a second zone. A control line is coupled to the first and second valves to communicate pressure to selectively actuate one of the first and second valves.

Other features and embodiments will become apparent from the following description, drawings, and claims.

DETAILED DESCRIPTION

Figure 1:
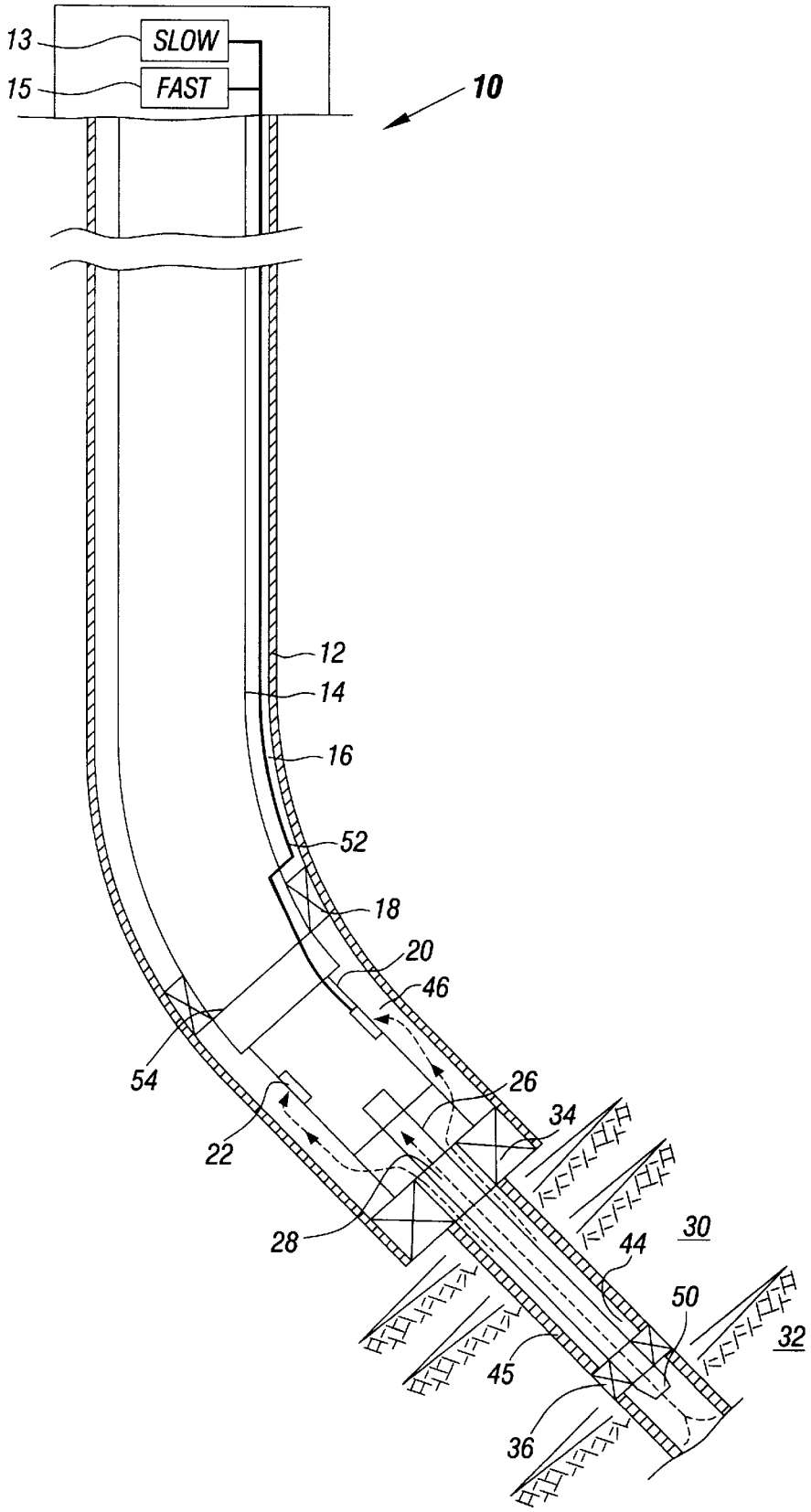
FIG. 1 illustrates an embodiment of a completion string positioned in a wellbore.

In the following description, numerous details are set forth to provide an understanding of the present invention.

However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

In a well with multiple producing zones, it is desirable to have the ability to control the flow from each zone at the well surface without any type of intervention. Selective control of individual producing zones may allow the shut off of certain zones, such as those producing water. Also, selective flow control may allow balancing of flowing pressure between zones which may result in increased recoverable hydrocarbons from well formations. In accordance with some embodiments, a pressure-activated mechanism for controlling flow control valves includes a control line that is coupled to a plurality of flow control valves. The flow control valves coupled to the control line may be selectively actuated to control fluid flow from corresponding zones. Also, a valve assembly in accordance with some embodiments is able to perform both flow control and isolation of a well having multiple zones.

In further embodiments, other types of pressure-actuated devices may be controlled using a control line and activating mechanism.

A multi-valve system in accordance with some embodiments may include multiple valve assemblies, which may comprise some combination of a ball valve assembly, a sliding sleeve valve assembly, and/or a disk valve assembly. Other types of valves may also be used in further embodiments. One embodiment of a disk valve is described in U.S. patent application Ser. No. 09/243,401, entitled "Valves for Use in Wells," filed Feb. 1, 1999; and U.S. patent application Ser. No. 09/325,474, entitled "Apparatus and Method for Controlling Fluid Flow in a Wellbore," filed Jun. 3, 1999, both having common assignee as the present application and both hereby incorporated by reference. As used here, a "valve" is intended to cover any type of flow control device that is capable of varying flow of fluid, including varying between an open position, a closed position, and/or one or more intermediate positions.

The valve assemblies in the multi-valve system may be actuated by one of several different mechanisms, including a mechanical mechanism (by use of a shifting tool) and a pressure-activated mechanism (by use of a control line run from the surface). In further embodiments, other actuation mechanisms may be used with the multi-valve system, including electrical actuation and hydraulic actuation through tubing-conveyed pressure or pressure conveyed through the tubing-casing annulus.

Referring to FIG. 1, a well 10 having multiple production zones 30 and 32 is illustrated. A first portion of the wellbore 10 is lined with casing 12. The production zones 30 and 32 may be located in a second portion of the wellbore 10 that is lined with a liner 45. Alternatively, the second portion of the wellbore 10 may be an open hole that is un-lined. A production tubing 14 is positioned inside the casing 12, and a production packer 18 isolates a tubing-casing annulus 16 from the region below the packer 18.

In accordance with some embodiments of the invention, a multi-valve system 20 is part of the illustrated completion string. In the illustrated embodiment, the multi-valve system 20 includes two valve assemblies: one sleeve valve assembly 22 and one ball valve assembly 24. In further embodiments, other combinations of valve assemblies may be used in the multi-valve system 20, including any combination of sleeve valve assemblies, disk valve assemblies, ball valve assemblies, and other types of valves. In addition, in other embodiments, more than two valve assemblies may be present in the multi-valve system 20.

A flow tube 26 (or any other flow conduit) is attached below the multi-valve system 20 and extends through a formation isolation valve (FIV) 28 that is connected to a packer 34. As illustrated, the FIV 28 is in the open position to allow the flow tube 26 to pass through the FIV. The flow tube 26 terminates at or near a lower packer 36 that is used to separate fluid flow paths from the upper and lower zones 30 and 32. If the second portion of the well 10 is un-lined, then sand control equipment, such as sand screen equipment and a gravel pack, may be positioned proximal the upper and lower zones 30 and 32.

Fluid from the upper formation zone 30 flows into an annulus region 44 outside the flow tube 26. The flow continues up the annulus region 44, through an annulus conduit in the FIV 28, and into the annulus region 46 outside the multi-valve system 20. The sleeve valve assembly 22 may be actuated opened or closed to control fluid flow into the production tubing 14. The sleeve valve assembly 22 may also be set at one or more intermediate positions between fully opened and closed. When a valve is set at an intermediate position, it provides some predetermined percentage (e.g., 25%, 33%, 50%, 67%, 75%, etc.) of the fully open flow rate.

Fluid from the lower zone 32 flows into the bore of the flow tube 26 up to the ball valve assembly 24 of the multi-valve system 20. The ball valve assembly 24 may be actuated open or closed to control fluid flow. In an alternative embodiment, the ball valve assembly 24 may be replaced with a sleeve valve or disk valve assembly to enable actuation to one or more intermediate positions between fully open and closed. Although this description makes reference to various components in a completion string, it is contemplated that further embodiments may not include such components, may include variations of such components, or may use other types of components.

In accordance with some embodiments, the valve assemblies 22 and 24 are run into the wellbore in the closed position to allow further completion operations to be performed, including the application of pressure down a tubing to set the packer 18. Setting the packer 18 and maintaining the valve assemblies 22 and 24 in the closed position provides isolation of the formation zones 30 and 32. Once the zones 30 and 32 are isolated, additional completion operations may be performed further uphole.

The completion procedure according to one example may be as follows. A string including the packers 34 and 36 and the FIV 28 may first be installed into the lower portion of the wellbore 10. A perforating gun string is then lowered into the wellbore 10 into the proximity of the lower formation zone 32, where it is activated to form perforations in the formation zone 32. Optionally, if commingling of fluids between the zones 30 and 32 is not desired, a lower FIV may also be connected to the packer 36. A shifting tool attached to the lower end of the perforating gun string may be used to actuate the lower FIV connected to the packer 36 as the gun string is pulled up through the lower FIV after perforation of the lower zone 32. Alternatively, the shifting tool may be attached to the lower end of a gravel pack service tool so that the FIV 28 may be actuated by the running in and pulling out of the gravel pack service tool.

The perforating gun string may have multiple sections, with one section fired to form perforations in the formation zone 32. After the gun string is pulled into the proximity of the upper formation zone 30, another section of the gun string may be fired to form perforations in the upper zone 30. The gun string is then pulled through the upper FIV 28, which closes the upper FIV 28 to isolate the upper zone 30. The gun string may then be pulled out of the wellbore.

Although the illustrated embodiment shows the use of the FIV 28, it is contemplated that an FIV separate from the multi-valve system 20 may not be needed in further embodiments. In such further embodiments, the multi-valve system 20 may provide adequate isolation during completion operations.

Next, the portion of the completion string including the packer 18, multi-valve system 20, a seal bore extension 54, and flow tube 26 is lowered into the wellbore 10. A shifting tool 50 may be attached to the lower end of the flow tube 26. When the shifting tool 50 engages a valve operator of the FIV 28, the FIV 28 is opened to allow the flow tube 26 to extend into the lower portion of the wellbore 10. Once the FIV 28 is opened, some fluid loss may occur until the assembly including the packer 18, multi-valve system 20, seal bore extension 54, and flow tube 26 is properly set. When the assembly is lowered to the desired depth, pressure applied down a pipe (used to carry the assembly) may then set the production packer 18. The set packer 18 and closed valve assemblies 22 and 24 provide isolation of the formation zones 30 and 32 remain isolated even though the FIV 28 has been opened.

The flow tube 26 is engaged to the packer 36 to provide two separate flow paths from and to the zones 30 and 32. If a lower FIV is connected to the packer 36, the shifting tool 50 at the lower end of the flow tube 26 may also be used to actuate that FIV open.

Next, the production tubing 14, one or more control lines 52, and other upper completion components may be installed. The lower end of the tubing 14 may be connected to the seal bore extension 54 connected to the multi-valve system 20 to form a sealed fluid conduit from the multi-valve system 20 to the well surface.

To provide interventionless activation of the valve assemblies 22 and 24 in the multivalve system 20, one or more control lines 52 may be run down the annulus 16 from the surface to the multi-valve system 20. The one or more control lines 52 may include control lines carrying electrical signals and control lines carrying fluid pressure (e.g., gas pressure or hydraulic pressure). In one embodiment, the fluid pressure in a control line 52 may be provided by nitrogen gas. However, in further embodiments, other types of gases or liquids may be used to provide the necessary pressure to selectively actuate one or both of the valve assemblies 22 and 24 in the multi-valve system 20.

In accordance with some embodiments, a single fluid-pressure control line 52 can be used to actuate two or more valve assemblies. This may be accomplished by setting different pressure levels to actuate different valve assemblies in the multi-valve system. By using a single line to actuate multiple valves, the number of control lines that need to be run downhole can be reduced. The single control line may be coupled to a control mechanism that is adapted to control actuation of the plural valve assemblies. The control mechanism may include plural valve actuators that correspond to the plural valve assemblies.

In summary, the well completion system as illustrated in FIG. 1 in accordance with some embodiments may include the following components: standard completion hardware for completing multiple open or cased hole zones; one or more FIVs to isolate the multiple zones; and a multi-valve system for performing formation isolation and flow control. The multi-valve system provides fluid loss and well isolation control during running of the upper completion and provides flow control during production or other operation of the well.

In one embodiment, control of the valve assemblies in the multi-valve system 20 may be performed by applying and bleeding off fluid pressure through the control line. Operation of a valve such as a ball valve using a control line that extends from the surface is described in U.S. Ser. No. 08/762,762, entitled "Surface Controlled Formation Isolation Valve Adapted for Deployment of a Desired Length of a Tool String in a Wellbore," filed Dec. 10, 1996, having common assignee as the present application and hereby incorporated by reference. Bleeding off of fluid pressure from a control line 52 may be performed through one of a fast bleed device 15 and a slow bleed device 13 in a bleed assembly at the well surface. The fast bleed device 15 is designed to bleed fluid pressure from a fluid carrying control line at a relatively predetermined fast rate. In contrast, the slow bleed device 13 is designed to bleed fluid pressure from a fluid carrying control line at a relatively predetermined slow rate. The operation of the fast and slow bleed devices 15 and 13 are described further below.

Figure 2:
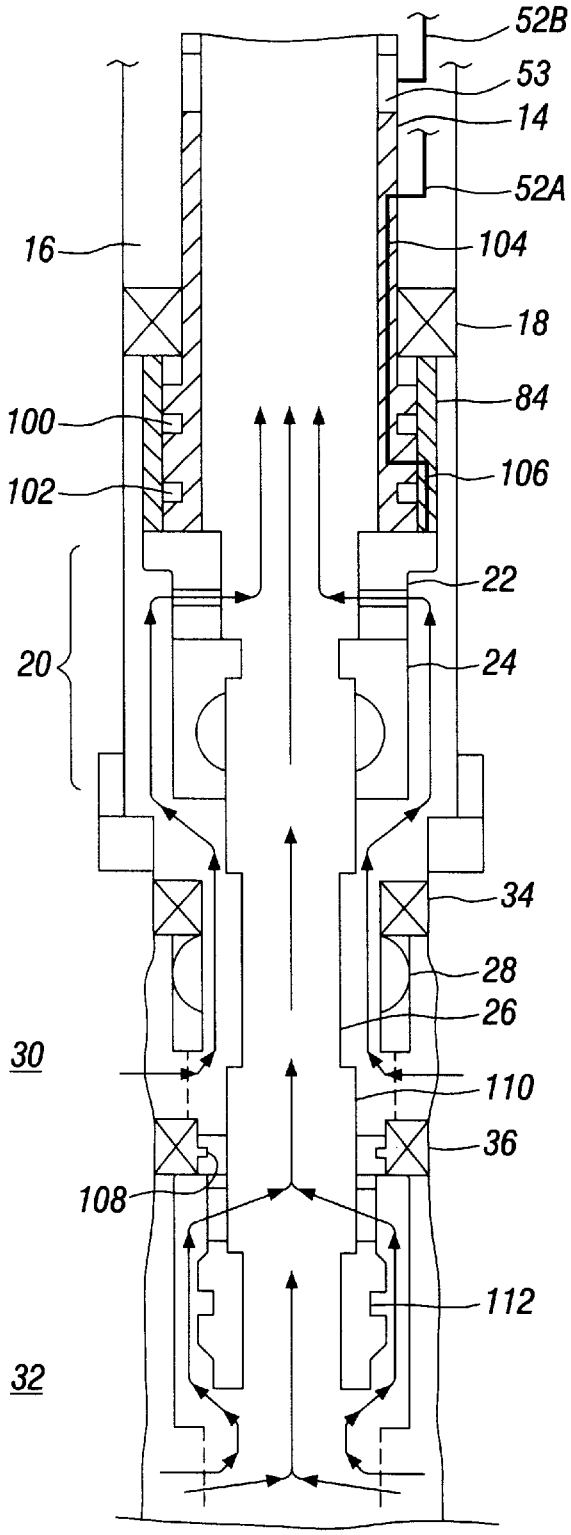
FIG. 2 illustrates a portions of the completion string of FIG. 1 including a multi-valve system in accordance with one embodiment that is adapted to perform both flow control and zone isolation.

Referring to FIG. 2, a portion of the well completion system shown in FIG. 1 is illustrated in greater detail. The production tubing 14 extends past the production packer 18 into the seal bore extension 54. Although shown as having a relatively short length, the seal bore extension 54 may actually extend for relatively long distances, if needed. An electrical control line 52B may extend in the casing-tubing annulus 16 to monitoring devices 53, such as sensors and gauges, attached to the tubing 14. A control line 52A, which is a fluid-pressure carrying control line, extends along the annulus region 16 and mates with a conduit 104 in the housing of the production tubing 14 above the packer 18. The conduit 104 extends down the production tubing housing to a lower portion of the production tubing 14 between two seals 100 and 102 (e.g., O-ring seals). The conduit 104 mates with another conduit 106 in the seal bore extension 54 to provide a fluid control path from the control line 52A to the multi-valve system 20.

As illustrated in FIG. 2, the multi-valve system 20 includes the sleeve valve assembly 22 and the ball valve assembly 24. The flow tube 26 connected to the multi-valve system 20 extends through the FIV 28. A flush joint portion 110 of the flow tube 26 provides a seal 108 that is engaged with the packer 36 to provide the separate, sealed flow paths for the upper and lower completion zones 30 and 32. The shifting tool 50 connected below the flow tube 26 has a latch profile 112 adapted to actuate the FIV 28 and other FIVs (if they exist).

Figure 3A:
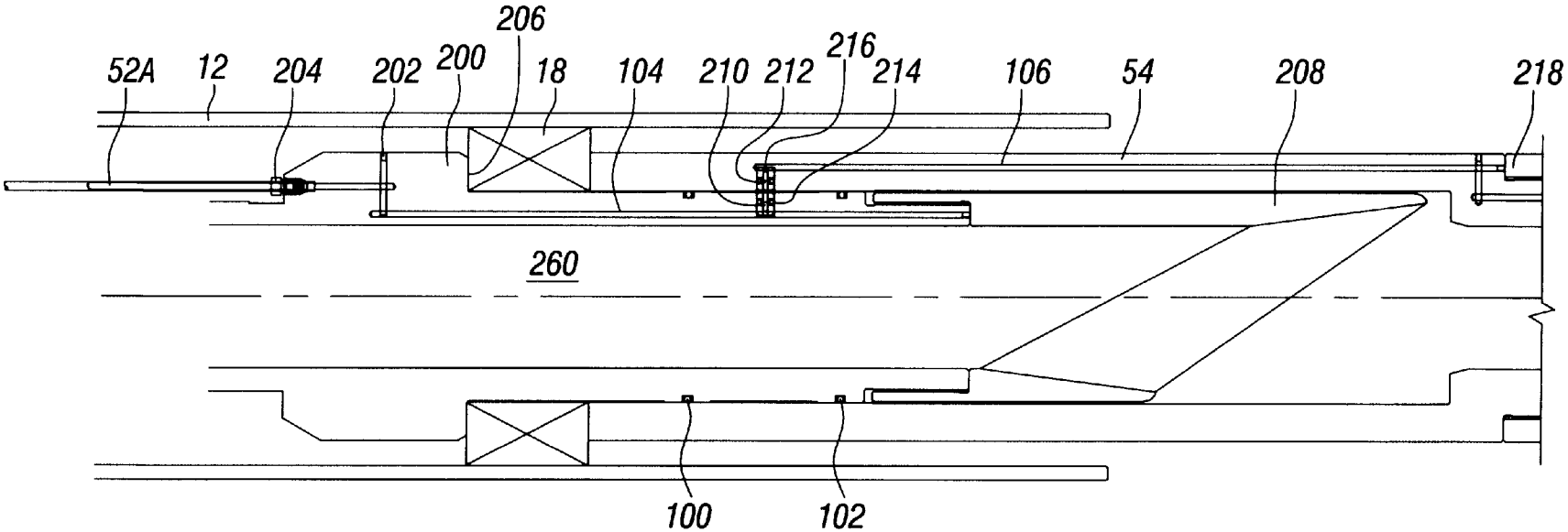
FIGS. 3A–3E are a cross-sectional view of the multi-valve system of FIG. 2.

Referring to FIGS. 3A-3E, the multi-valve system 20, the seal bore extension 54, the lower portion of the production 14, and the lower portion of the control line 52A are illustrated in greater detail. As shown in FIG. 3A, the control line 52A is connected to the conduit 104 in the bottom housing 200 of the production tubing 14 by a fitting 204. The production tubing housing 200 has a lower shoulder 206 adapted to land on the production packer 18. At its lower end, the production tubing housing 200 is threadably connected to a stinger member 208. The stinger member 208 and lower portion of the production tubing housing 200 are adapted to fit into the seal bore extension 54. Once the lower shoulder 206 of the bottom production tubing housing 200 lands on the packer 18, a port 210 connected to the conduit 104 in the production tubing housing 200 is aligned with a port 212 that leads to the conduit 106 in the seal bore extension 54. To prevent fluid from flowing into respective conduits 104 and 106 as the production tubing 14 and seal bore extension 54 are lowered into the wellbore 10, rupture elements 214 and 216 (e.g., rupture disks) are provided in the ports 210 and 212, respectively. The rupture disks are adapted to rupture at a predetermined pressure applied down the control line 52A.

The ports 210 and 212 extend to a location between the pair of seals 100 and 102. In further embodiments, additional control lines and corresponding control conduits and ports may be added. In such further embodiments, additional seals may be provided to isolate the different control lines.

Figure 3B:
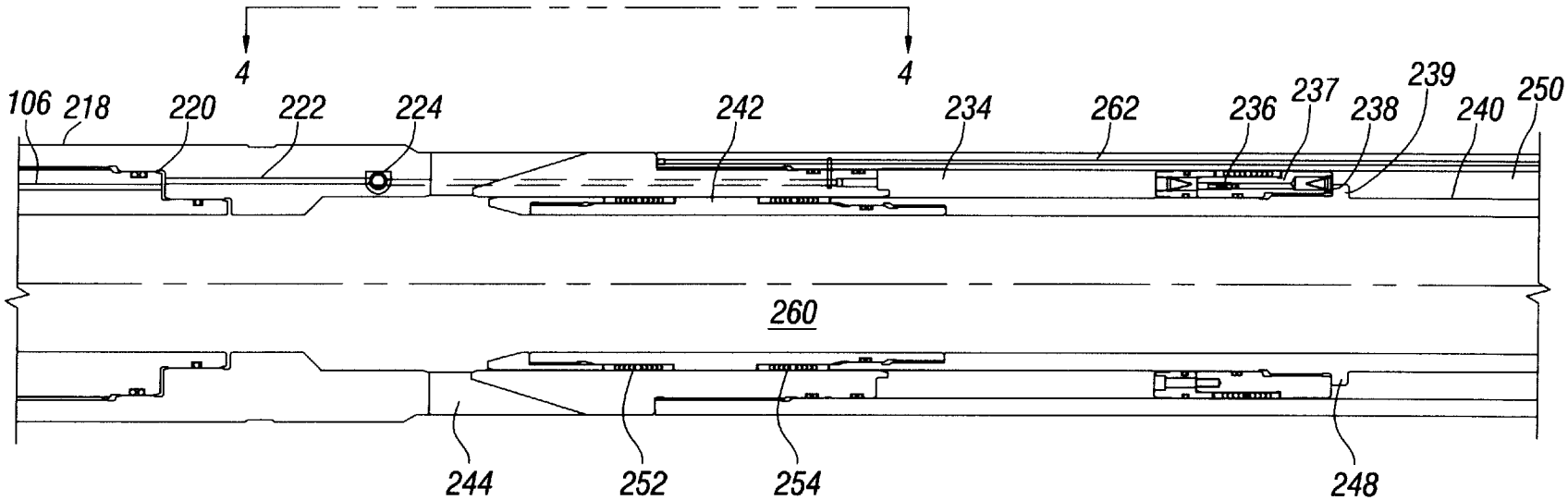

As seen in FIG. 3B, the lower part of the seal bore extension 54 is threadably connected to a top sub 218 of the multi-valve system 20. The conduit 106 in the seal bore extension 54 housing extends to the lower part of the seal bore extension 54. The conduit 106 is in communication with a gap 220 between the seal bore extension 54 and the top sub 218. In turn, a conduit 222 in the top sub 218 is in communications with the gap 220. Thus, once the production tubing housing 200 and stinger member 208 are positioned in the seal bore extension 54, any pressure applied down the control line 52A is communicated down the conduits 104 and 106 to the top sub conduit 222.

Figure 4:
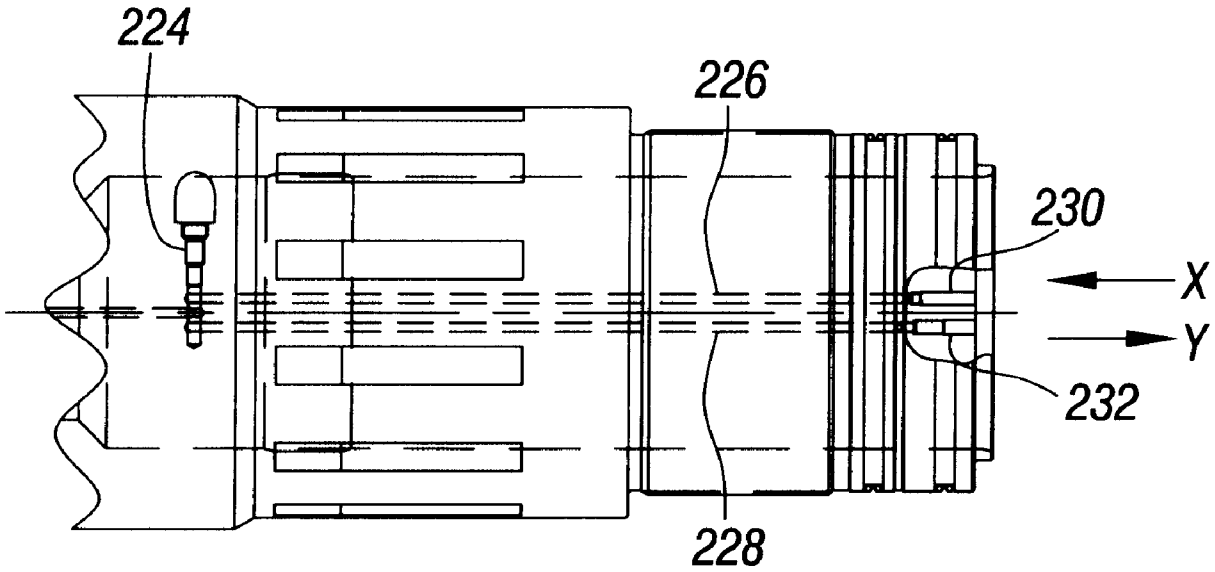
FIGS. 4 and 5 are cross-sectional views of portions of the multi-valve system of FIGS. 3A–3B.

The conduit 222 in the top sub 218 leads to a multi-port pressure communication adapter 224 that connects the conduit 222 to a check valve conduit 226 and a relief valve conduit 228, as shown in FIG. 4. As further shown in FIG. 4, the relief valve conduit 228 leads to a relief valve 232, while the check valve conduit 226 leads to a check valve 230. The check valve 230 is adapted to allow flow only in one direction. In the illustrated embodiment, the check valve 230 allows flow in the direction indicated by the arrow X. The relief valve 232 is adapted to allow pressure to be communicated in the direction indicated by the arrow Y when the pressure in the conduit 228 exceeds a first predetermined pressure. In one example embodiment, the relief valve 232 is adapted to allow pressure communication when the pressure in the conduit 228 exceeds 2,500 psi (pounds per square inch).

The check valve 230 and relief valve 232 provide pressure communication to the valve actuator in the sleeve valve assembly 22. The relief valve 230 communicates pressure greater than a first predetermined level to the valve actuator, while the check valve 230 is adapted to bleed pressure from the valve actuator. In the illustrated embodiment, the sleeve valve assembly 22 is actuated by a predetermined pressure in the control line 52A that is communicated to an upper nitrogen chamber 234 defined between an intermediate outer housing 264 and an operator mandrel 240. Pressure in the gas chamber 234 is applied against a piston 237, which is threadably attached to the outside of the operator mandrel 240. In addition, a gas metering device 236, which sits on a shoulder 238 defined by a flange 239 of the operator mandrel 240, provides fluid communication between the upper and lower chambers 234 and 250 at a predetermined bleed rate. An example of a gas metering device that may be used is the JEVA device provided by the Lee Company, having a business address in Westbrook, Conn. Other forms of bleed elements may also be used.

The operator mandrel 240 is connected to a sliding sleeve 242 in the sleeve valve assembly 22. In the illustrated position, the sliding sleeve 242 is in its down (or open) position to expose one or more flow ports 244 in the top sub 218 of the multi-valve system 20. A lower gas chamber 250 is formed between the intermediate housing 264 and the operator mandrel 240 below the metering device 236. The gas metering device 236 is adapted to communicate gas between the chambers 234 and 250 to allow pressure to equalize at a predetermined slow rate. The predetermined slow rate at which gas bleeds through the gas metering device 236 is greater than the bleed rate of the slow bleed device 13 (FIG. 1) at the well surface but less than the fast bleed rate of the fast bleed device 15 at the well surface.

A differential pressure between the upper and lower gas chambers 234 and 250 provides the power to move the operator mandrel 240 up or down to actuate the sliding sleeve 242 between an open or closed position. The closed position of the sliding sleeve 242 is the up position, where seals 252 and 254 are positioned on either side of flow ports 244 to seal fluid from flowing into the bore 260 of the multi-valve system 20.

Figure 3C:
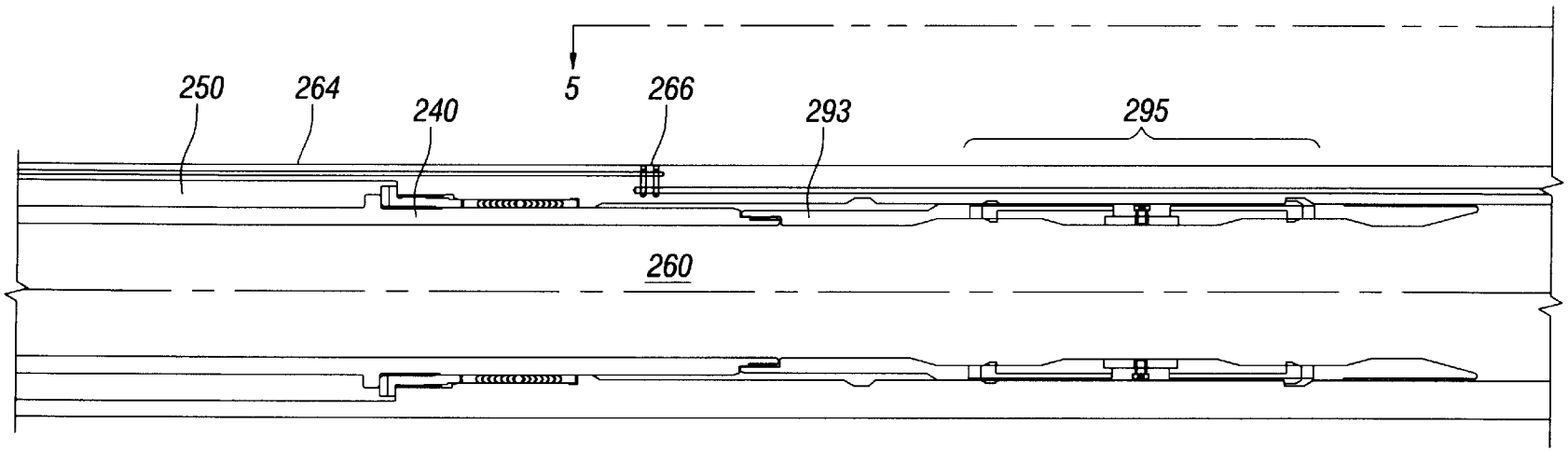

In accordance with some embodiments, pressure in the same control line 52A may be used to control actuation of one or more other valve assemblies in the multi-valve system 20. To communicate pressure in the control line 52A to the ball valve assembly 24 in the multi-valve system 20, a conduit 262 is provided in the intermediate housing 264. The conduit 262 is in communications with either of the check valve or relief valve conduit 226 or 228 (FIG. 4). Pressure communicated down the control line 52A through the production conduit 104, seal bore extension conduit 106, and top sub conduit 222 is communicated to the intermediate housing conduit 262, which extends to a second multi-port pressure communication adapter 266, as shown in FIG. 3C.

Figure 5:
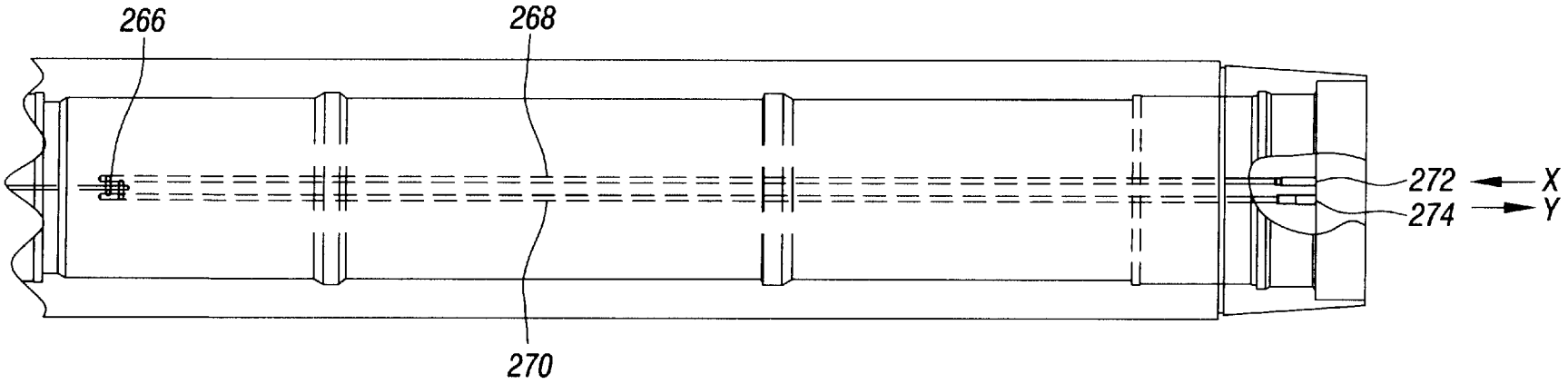

As further shown in FIG. 5, the adapter 266 connects the conduit 262 to a second check valve conduit 268 and a second relief valve conduit 270. The check valve conduit 268 leads to a second check valve 272, while the relief valve conduit 270 leads to a second relief valve 274. The relief valve 274 is set to allow pressure communications in the direction indicated by Y when the pressure in the relief valve conduit 270 exceeds a second predetermined pressure. In some embodiments, the second predetermined pressure set for the relief valve 274 is greater than the first predetermined pressure set for the relief valve 232 in FIG. 4. In one example embodiment, the second predetermined pressure for the relief valve 274 is about 3,000 psi (compared to about 2,500 psi for the first relief valve 232).

Figure 3D:
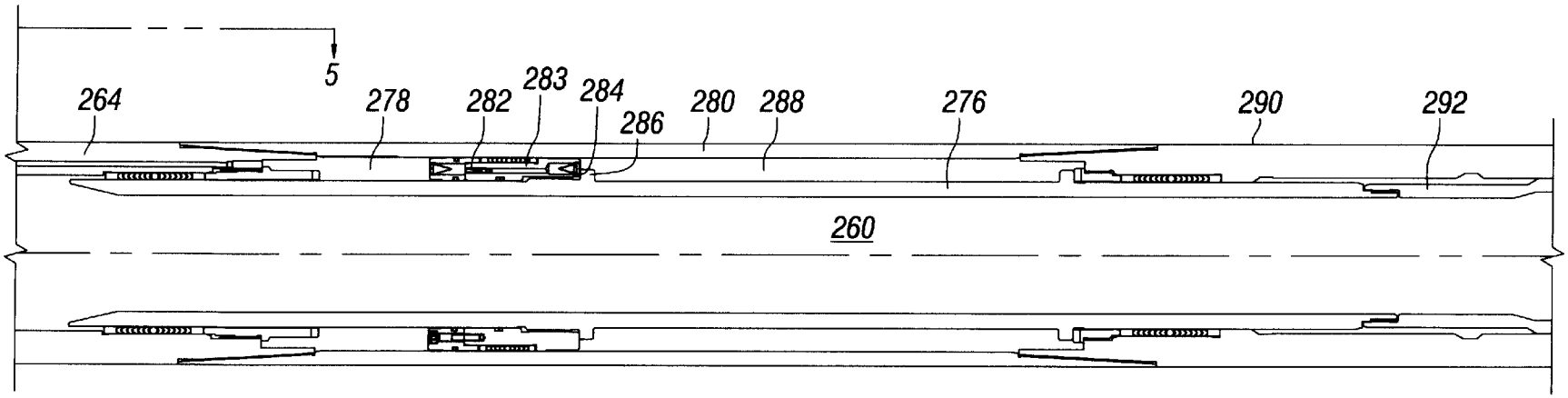

As shown in FIG. 3D, pressure is applied down the relief valve conduit 270 and through the relief valve 274 to actuate an operator mandrel 276 for the ball valve assembly 24, while pressure is bled away through the check valve 272 and check valve conduit 268 to release pressure from the operator mandrel 276. Both the check valve 272 and relief valve 274 are in communication with a second upper gas chamber 278 defined between a second intermediate housing 280 and the operator mandrel 276 in the ball valve assembly 24. The upper gas chamber 278 is in communication with a second gas metering device 282, which sits on a shoulder 284 of a flange 286 of the operator mandrel 276. A lower gas chamber 288 sits below the gas metering device 282 inside the second intermediate housing 280. Differential pressure between the upper and lower gas chambers 278 and 288 provides the power against a piston 283 threadably attached to the operator mandrel 276 to move the operator mandrel 276 up or down. This causes actuation of a ball valve 298 in the ball valve assembly 24 to an open or closed position. The lower end of the operator mandrel 276 is connected to a latch operator 292, which is in turn connected to an operator member 296 adapted to actuate the ball valve 298.

Figure 3E:
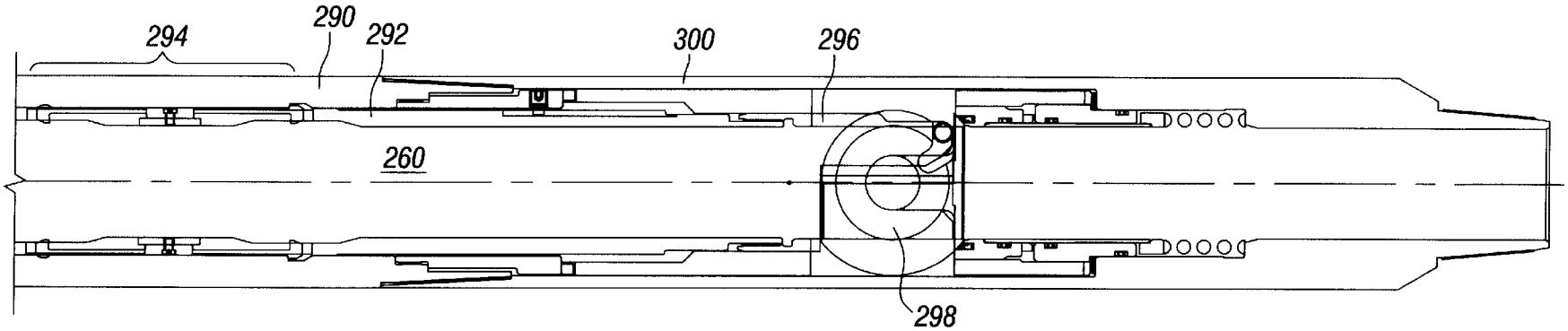

As shown in FIGS. 3D and 3E, the latch operator 292 has a latch portion 294 adapted to be engaged by a shifting tool run in the bore 260 of the multi-valve system 20. The latch operator 292 is located inside a housing section 290 of the multi-valve system 20. The lower portion of the latch operator 292 is connected to the operator member 296 that is adapted to operate a ball valve 298 between an open and closed position. The illustrated position of the ball valve 298 is the open position. The ball valve 298 is located inside a housing section 300 of the multi-valve system 20.

As shown in FIG. 3C, the sleeve valve assembly 22 is also associated with a latch operator 293 that is connected to the lower end of the sleeve valve operator mandrel 240. The latch operator 293 includes a latch profile 295 that is adapted to be engaged by a shifting tool run in the bore 260 of the multi-valve system 20. The latch operator 292 and 293 in the ball and sleeve valve assemblies, respectively, are used as back-up or fail-safe mechanisms to actuate the ball and sleeve valve assemblies with a shifting tool in case the fluid-pressure activated mechanism fails.

In further embodiments, the valve assemblies 22 and 24 of FIGS. 3A–3E may be modified to allow each of the valve assemblies to be varied between open and closed positions as well as to one or more intermediate positions. In one example arrangement, the ball valve assembly 24 may be replaced with a sleeve valve or disk valve assembly.

To provide the indexing needed to set a valve assembly at an intermediate position, some form of indexing mechanism that is known in the art may be utilized. Typically, such indexing mechanisms include some type of a sleeve including a J slot pattern to allow a valve operator to move to intermediate positions. Such a mechanism can be connected to the valve operators 240 and 276 in the multi-valve system 20. In another arrangement, an indexing mechanism as described in U.S. patent application Ser. No. 09/346,265, entitled "Apparatus and Method for Controlling Fluid Flow," filed Jul. 1, 1999, having common assignee as the present application and hereby incorporated by reference.

To actuate the operator mandrel 240 down to open the sleeve valve assembly 22, predetermined fluid pressure applied down the control line 52A is communicated to the upper chamber 234 through the relief valve 232. This causes a differential pressure to be created between the chambers 234 and 250 in the sleeve valve assembly 22, which moves the operator mandrel 240 down to open the sleeve valve assembly 22. After some predetermined period, the gas metering device 236 equalizes the pressure between the two chambers 234 and 250. Thereafter, to maintain the sleeve valve assembly 22 open, the pressure in the upper chamber 234 may be bled off through the slow bleed device 13 at the surface. This allows pressure in the two chambers 234 and 250 to remain equalized, thereby keeping power from being applied against the operator mandrel 240. However, to close the sleeve valve assembly 22, the pressure in the upper chamber 234 is bled off through the surface fast bleed device 15, which causes a differential pressure between the chambers 234 and 250 to move the operator mandrel 240 upwardly to close the sliding sleeve 242.

The operator mandrel 276 in the ball valve assembly 24 is operated in similar fashion.

In operation, both the sleeve valve assembly 22 and the ball valve assembly 24 start in the closed position. To open both valve assemblies, the pressure in the control line 52A is increased to about 3,000 psi or greater. When this occurs, the relief valve 232 of the sleeve valve assembly 22 and the relief valve 274 of the ball valve assembly 24 allow communication of the gas pressure to respective upper gas chambers 234 and 278. This creates a differential pressure between the upper gas chambers 234, 278 and respective lower gas chambers 250, 288. As a result, respective operator mandrels 240, 276 are moved downwardly to open both the sleeve valve assembly 22 and the ball valve assembly 24.

If both valve assemblies are open and it is desired to close both valve assemblies, pressure in the control line 52A is raised to approximately 3,000 psi or greater. After a predetermined wait period, pressure is equalized in the upper gas chambers 234, 278 and respective lower gas chambers 250, 288. Next, gas pressure is bled off at a fast rate through the fast bleed device 15 at the surface, which removes pressure from the upper gas chambers 234, 278 of respective valve assemblies 22, 24 at a relatively fast rate. When this occurs, the pressure in the lower gas chambers 250, 288 become greater than the gas pressure in respective upper gas chambers 234, 278, which causes respective operator mandrels 240, 276 to move upwardly to close respective valve assemblies 22, 24.

If both valves are in the closed position, and it is only desired to open the sleeve valve assembly 22, pressure in the control line 52A may be raised to about 2,500 psi. This causes the sleeve valve assembly 22 to open and the ball valve assembly 24 to remain closed. Pressure is bled off from the control line 52A slowly through the slow bleed device 13 at the surface, which allows the sleeve valve assembly 22 to remain open and the ball valve assembly 24 to remain closed.

However, if both valve assemblies start in the closed position and only the ball valve assembly 24 is to be opened, pressure in the control line 52A is raised to about 3,000 psi. Both valve assemblies will open. Pressure in the control line 52A is then bled down slowly. Both valve assemblies remain open. Next, only the sleeve valve assembly 22 is closed. This is accomplished by raising the pressure in the control line 52A to about 2,500 psi. A predetermined wait period later, pressure is equalized across the upper and lower gas chambers 234 and 250 in the sleeve valve assembly 22. Note that the approximately 2,500 psi pressure does not reach the upper gas chamber 278 in the ball valve assembly 24 because the associated pressure relief valve 274 (FIG. 5) does not open. Gas in the control line 52A is then bled off at a fast rate. The sleeve valve assembly 22 closes while the ball valve assembly 24 remains open.

If both valve assemblies are open and it is only desired to close the ball valve assembly 24, pressure in the control line 52A is raised to about 3,000 psi. A predetermined wait period later, pressure is equalized across upper gas chamber 234, 278 and respective lower gas chamber 250, 288. Pressure is then bled off at a fast rate, which causes both valve assemblies to close. The process of opening only the sleeve valve assembly 22 as described above is performed so that the sleeve valve assembly 22 is opened while the ball valve assembly 24 remains closed.

In another scenario, the sleeve valve assembly 22 may be open and the ball valve assembly 24 may be closed. To change the position of the sleeve valve assembly 22 to closed and the ball valve assembly 24 to open, pressure in the control line 52A is raised to approximately 3,000 psi. As a result, both valve assemblies open. After a predetermined wait period, the pressure is equalized across the gas chambers. Pressure is then bled off slowly to allow both valve assemblies to remain open. Then, the procedure described above to close the sleeve valve assembly 22 is performed to close the sleeve valve assembly 22 while keeping the ball valve assembly 24 open.

Using the procedures described above, the valve assemblies 22 and 24 may be actuated to any desired position using only a single control line 52A that is in communication with both valve assemblies in the multi-valve system.

Some embodiments of the invention may provide one or more of the following advantages. The same multi-valve system may be used to provide both isolation and flow control. This provides a simple, economical and reliable system of isolating one or more zones during completion and providing flow control during production. By using the same multi-valve system to perform both isolation and flow control, the amount of hardware that is needed in the wellbore may be reduced. Using the completion string in accordance with one embodiment, when a work string is pulled out, one or more FIVs may be automatically closed to provide isolation. When the work string is re-installed, the one or more FIVs may be automatically opened without intervention.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A multi-valve apparatus for use in a well having a plurality of zones, comprising:

a first valve in communication with a first zone;

a second valve in communication with a second zone;

a control line coupled to the first and second valves to communicate pressure to selectively actuate one of the first and second valves;

a first mechanism responsive to a first pressure in the control line to communicate pressure in the control line to actuate the first valve; and a second mechanism responsive to a second, different pressure in the control line to communicate pressure in the control line to actuate the second valve.

2. The multi-valve apparatus of claim 1, further comprising a first valve actuator coupled to the control line and a second valve actuator coupled to the control line, wherein at least one of the first and second valve actuators includes:

a first chamber and a second chamber; and an operator mandrel movable by differential pressure between the first and second chambers.

3. The multi-valve apparatus of claim 2, wherein at least one of the first and second valve actuators further includes a bleed element separating the first and second chambers, the bleed element adapted to communicate fluid between the first and second chambers at a predetermined rate.

4. The multi-valve apparatus of claim 3, wherein a first bleed device and a second bleed device is coupled to the control line at the well surface, the first bleed device having a first bleed rate and the second bleed device having a second bleed rate, and wherein the predetermined rate of the bleed element is greater than the first bleed rate but less than the second bleed rate.

5. The multi-valve apparatus of claim 1, wherein the well includes a conduit to receive production fluids, and wherein the control line is separate from the conduit.

6. The multi-valve apparatus of claim 1, wherein at least one of the first and second valves may be actuated to an open position, a closed position, and at least one intermediate position.

7. The multi-valve apparatus of claim 1, further comprising an actuator mechanism to enable actuation of the first and second valves by a shifting tool.

8. The multi-valve apparatus of claim 7, wherein the actuator mechanism includes first and second latch profiles engageable by the shifting tool.

9. A multi-valve apparatus for use in a well having a plurality of zones, comprising:

a first valve in communication with a first zone;

a second valve in communication with a second zone;

a control line coupled to the first and second valves to communicate pressure to selectively actuate one of the first and second valves; and a first valve actuator coupled to the control line and a second valve actuator coupled to the control line, wherein each of the first and second valve actuators includes:

a first chamber and a second chamber;

an operator mandrel movable by differential pressure between the first and second chambers; and a pressure relief valve in communication with the control line and the first chamber, the pressure relief valve adapted to enable communication of pressure in the control line to the first chamber if the pressure exceeds a predetermined level.

10. The multi-valve apparatus of claim 9, wherein the predetermined level of the first valve actuator pressure relief valve is different from the predetermined level of the second valve actuator pressure relief valve.

11. The multi-valve apparatus of claim 9, wherein each of the first and second valve actuators further includes:

a check valve in communication with the first chamber to release pressure from the first chamber.

12. The multi-valve apparatus of claim 9, wherein each of the first and second valve actuators further includes:

a latch operator having a latch profile adapted to be engaged by a shifting tool.

13. The multi-valve apparatus of claim 1, wherein the first mechanism comprises a first relief valve, and the second mechanism comprises a second relief valve.

14. The multi-valve apparatus of claim 1, wherein the first mechanism prevents pressure in the control line from actuating the first valve if the control line pressure is less than the first pressure, and wherein the second mechanism prevents pressure in the control line from actuating the second valve if the control line pressure is less than the second pressure.

15. The multi-valve apparatus of claim 14, further comprising a first valve actuator and a second valve actuator, the first mechanism to couple the control line pressure to the first valve actuator if the control line pressure is greater than the first pressure, and the second mechanism to couple the control line pressure to the second valve actuator if the control line pressure is greater than the second pressure.

16. A completion string for use with a well having a plurality of zones, comprising:

a multi-valve system including a plurality of valves;

at least one flow conduit coupled to the multi-valve system to define a plurality of separate fluid flow paths from the plurality of zones, the plurality of valves initially set in a closed position to isolate the plurality of zones;

at least one control mechanism adapted to be activated from the well surface to operate the plurality of valves to provide flow control for the plurality of zones during production of the zones; and a control line adapted to carry fluid pressure to the at least one control mechanism wherein the at least one control mechanism includes a plurality of valve actuators coupled to respective valves, the plurality of valve actuators adapted to be activated by different pressure levels in the control line.

17. The completion string of claim 16, wherein the fluid pressure includes gas pressure.

18. The completion string of claim 16, wherein each valve actuator includes a pressure relief valve that is set to open at a predetermined pressure level, the predetermined pressure levels of the plural pressure relief valves being different.

19. The completion string of claim 16, further comprising one or more formation isolation valves adapted to isolate the plurality of zones to enable completion operations above the one or more formation isolation valves.

20. The completion string of claim 16, further comprising:

a seal bore member attached above the multi-valve system; and a tubing having a lower portion adapted to be sealably engaged in the seal bore member.

21. A completion string for use with a well having a plurality of zones, comprising:

a multi-valve system including a plurality of valves;

at least one flow conduit coupled to the multi-valve system to define a plurality of separate fluid flow paths from the plurality of zones, the plurality of valves initially set in a closed position to isolate the plurality of zones;

at least one control mechanism adapted to be activated from the well surface to operate the plurality of valves to provide flow control for the plurality of zones during production of the zones;

one or more formation isolation valves adapted to isolate the plurality of zones to enable completion operations above the one or more formation isolation valves; and a shifting tool attached to a lower end of the at least one flow conduit, the shifting tool adapted to engage each of the one or more formation isolation valves to open the one or more formation isolation valves during installation of the flow conduit.

22. A completion string for use with a well having a plurality of zones, comprising:

a multi-valve system including a plurality of valves;

at least one flow conduit coupled to the multi-valve system to define a plurality of separate fluid flow paths from the plurality of zones, the plurality of valves initially set in a closed position to isolate the plurality of zones;

at least one control mechanism adapted to be activated from the well surface to operate the plurality of valves to provide flow control for the plurality of zones during production of the zones;

a seal bore member attached above the multi-valve system; and a tubing having a lower portion adapted to be sealably engaged in the seal bore member, wherein the tubing includes a housing and the seal bore member includes a housing, the tubing housing having a conduit and the seal bore member housing having a conduit in alignment with the tubing housing conduit, the completion string further comprising a control line coupled to the tubing housing conduit.

23. The completion string of claim 22, further comprising a first rupture element to block fluid flow in the tubing conduit and a second rupture element to block fluid flow in the seal bore member housing conduit.

24. The completion string of claim 23, wherein the first and second rupture elements are adapted to be ruptured by a predetermined pressure in the control line.

25. The completion string of claim 23, wherein the tubing conduit and the seal bore member housing conduit are adapted to be aligned when the tubing is engaged with the seal bore member.

26. Equipment for use with a well having a plurality of zones, comprising:

a multi-valve system including a plurality of valves and a plurality of valve actuators;

a control line adapted to provide fluid pressure to the multi-valve system for operation of the plurality of valves, one of the valve actuators responsive to a first pressure level in the control line and another one of the valve actuators responsive to a second, different pressure level in the control line; and a bleed assembly coupled to the control line, the bleed assembly including a first bleed device having a first bleed rate and a second bleed device having a second bleed rate.

27. The equipment of claim 26, wherein each of the plurality of valve actuators includes a bleed element having a predetermined bleed rate that is greater than the first bleed rate but less than the second bleed rate.

28. Equipment for use with a well having a plurality of zones, comprising:

a multi-valve system including a plurality of valves;

a control line adapted to provide fluid pressure to the multi-valve system for operation of the plurality of valves; and a bleed assembly coupled to the control line, the bleed assembly including a first bleed device having a first bleed rate and a second bleed device having a second bleed rate, wherein the multi-valve system includes a plurality of valve actuators adapted to operate respective valves, the valve actuators coupled to the control line, wherein each of the valve actuators includes a bleed element having a predetermined bleed rate that is greater than the first bleed rate but less than the second bleed rate, wherein each of the plurality of valve actuators is adapted to be activated at a different pressure level in the control line, wherein the first bleed device bleeds fluid pressure from the control line to maintain the respective valve in its current state, and wherein the second bleed device bleeds fluid pressure from the control line to actuate the respective valve to a predetermined state.

29. A method for use in a well having a plurality of zones, comprising:

installing a multi-valve system having a plurality of valves in the well to provide flow control for the plurality of zones;

applying pressure in a control line to selectively actuate the plurality of valves in the multi-valve system to control production flow from the plurality of zones; and applying different levels of pressures in the control line to open different ones of the plurality of valves and releasing pressure from the control line at a predetermined rate to close one or more of the plurality of valves.

30. The method of claim 29, wherein releasing pressure from the control line at less than the predetermined rate allows a valve in an open state to remain open.

31. The method of claim 30, wherein releasing pressure from the control line includes releasing through one of a first bleed device and a second bleed device at the well surface.

32. A system for use in a well, comprising:

a tubing having a lower portion;

a control line coupled to the tubing;

a seal bore extension adapted to be sealably engaged with the tubing lower portion and having a conduit in communication with the control line;

a valve assembly adapted to be actuated by pressure in the control line received through the conduit of the seal bore extension.

33. The system of claim 32, wherein the tubing lower portion has a conduit, the tubing lower portion conduit in communication with the control line and the seal bore extension conduit.

34. A system for use in a well having a plurality of zones, comprising:

a valve apparatus to isolate the plurality of zones;

a shifting tool coupled to an end of the valve apparatus; and a formation isolation valve actuatable by the shifting tool as the valve apparatus is lowered or raised in the well.

35. The system of claim 34, wherein the formation isolation valve comprises a bore to enable passage of an intervention tool if the formation isolation valve is open.

36. The system of claim 35, wherein the formation isolation valve comprises a ball valve.

37. A method of completing a well having a plurality of zones, comprising:

installing a multi-valve system having a plurality of valves in the well, each of the plurality of valves in the closed position to provide isolation of the plurality of zones;

performing completion operations above the multi-valve system with the valves in the closed position; and supplying one or more actuating signals to the multi-valve system to selectively actuate the plurality of valves, wherein supplying the one or more actuating signals includes supplying different levels of fluid pressure in a control line to the multi-valve system to actuate different ones of the valves.

38. The method of claim 37, wherein performing the completion operations includes providing a tubing, the method further comprising providing a seal bore member above the multi-valve system, and sealably engaging a lower end of the tubing in the seal bore member.

39. A method for use in a well, comprising:

installing at least one formation isolation valve to isolate a plurality of zones;

running a tool past the at least one formation isolation valve to perform one or more operations in one or more of the plurality of zones;

closing the at least one formation isolation valve;

running a multi-valve system into the well, the multi-valve system having an operator to open the formation isolation valve in response to the operator engaging the formation isolation valve; and selectively actuating one or more of plural valves in the multi-valve system to produce fluids from one or more of the plurality of zones.

40. The method of claim 39, wherein selectively actuating the one or more plural valves comprises providing a pressure in a control line coupled to the plural valves.

41. The method of claim 40, wherein actuating the one or more plural valves comprises providing a first pressure level in the control line to actuate a first valve and providing a second, different pressure level in the control line to actuate a second valve.

* * * * *